United States Patent [19]

Yoshida

[11] 3,965,661

[45] June 29, 1976

[54] THREAD DRAWOFF TUBE FOR AN OPEN-END SPINNING UNIT

[75] Inventor: Yoshiaki Yoshida, Kariya, Japan

[73] Assignees: Kabushiki Kaisha Toyoda Jidoshokki Seisakusho; Daiwa Boseki Kabushiki Kaisha, Osaka, both of Japan

[22] Filed: Apr. 18, 1974

[21] Appl. No.: 461,930

[30] Foreign Application Priority Data

Apr. 21, 1973 Japan ..... 48-45530

[52] U.S. Cl. ..... 57/58.89; 57/77.4; 57/106

[51] Int. Cl.[2] ..... D01H 1/12; D01H 13/04

[58] Field of Search ..... 57/58.89–58.95, 57/77.3, 77.4, 77.42, 106

[56] References Cited

UNITED STATES PATENTS

| | | | |
|---|---|---|---|
| 3,481,128 | 12/1969 | Landuehrkamp et al. | 57/58.89 |
| 3,640,061 | 2/1972 | Landuehrkamp | 57/58.89 |
| 3,696,604 | 10/1972 | Nozaki et al. | 57/58.95 |
| 3,778,989 | 12/1973 | Schon | 57/58.89 |
| 3,789,597 | 2/1974 | Schon | 57/58.89 |
| 3,805,505 | 4/1974 | Schuster | 57/58.89 |
| 3,822,541 | 7/1974 | Croasdale et al. | 57/58.89 |
| 3,844,100 | 10/1974 | Croasdale et al. | 57/58.89 |

*Primary Examiner*—John Petrakes
*Attorney, Agent, or Firm*—Burgess, Ryan and Wayne

[57] ABSTRACT

In a spinning apparatus comprising a spinning rotor and a centrally arranged thread drawoff tube for drawing off thread from the spinning chamber, an improved thread drawoff tube having a thread passage for delivering the thread from the tube is provided, the thread passage being provided with a combination of a curved ring shaped friction surface and a flat ring shaped friction surface formed outside of the curved ring shaped surface, the friction resistance of the thread passage decreasing toward the outer edge of the flat ring shaped surface.

10 Claims, 11 Drawing Figures

Fig. 1
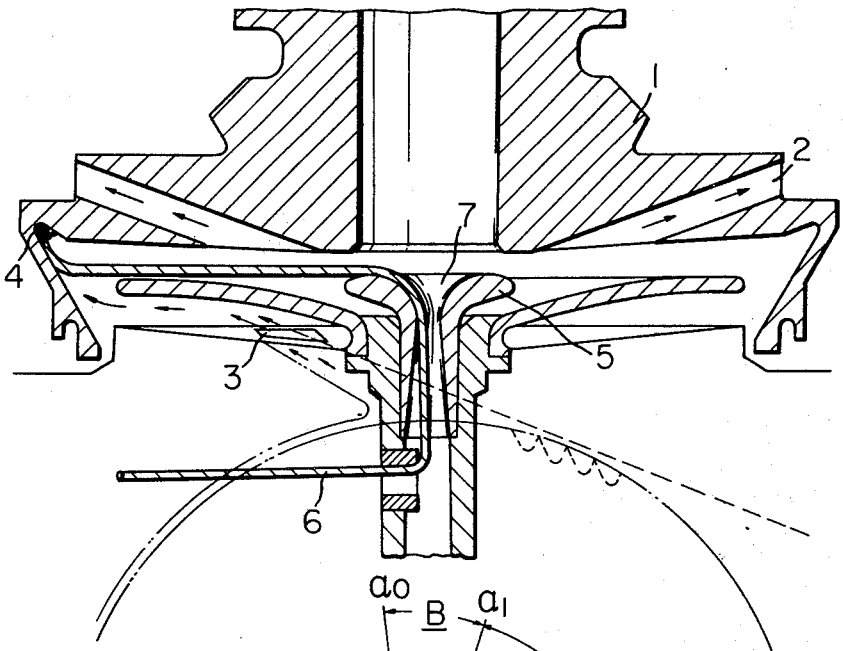
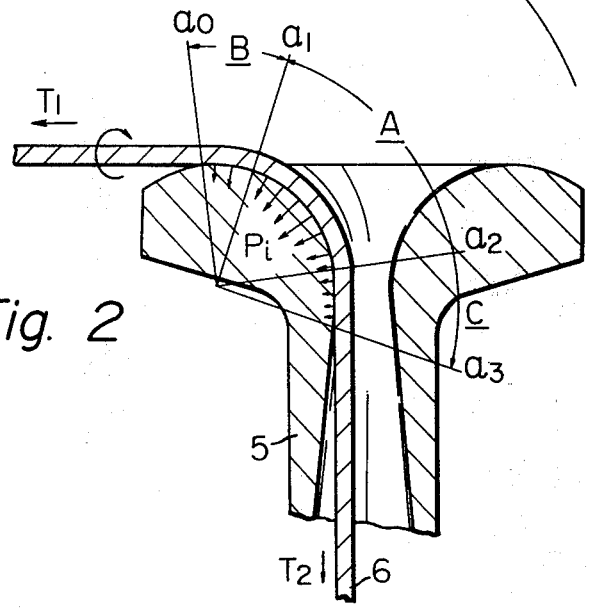
Fig. 2

THREAD DRAWOFF TUBE FOR AN OPEN-END SPINNING UNIT

SUMMARY OF THE INVENTION

The present invention relates to an improved thread drawoff tube for an open-end spinning unit.

It is well known that in an open-end spinning unit of the type having a spinning rotor and a thread drawoff tube assembled with the spinning rotor, a bundle of fibers, which is the upstream portion of a spun thread, is drawn off at the thread binding-in point of a fiber collecting surface on the spinning rotor. The above-mentioned bundle of fibers is provided with false twists in a yarn passage between the thread binding-in point and the mouth of the thread drawoff tube so that the bundle of fibers is formed into a spun thread. Major twists are imparted to the thread by the high speed rotation of the thread binding-in point as the rotor turns. The above-mentioned false twists are created by frictional contact of the thread with the mouth of the thread drawoff tube.

It is also known that the false twisting of the end of the thread in the spinning rotor has a substantial influence on thread formation and the quality of the thread. Therefore, several attempts to create a useful false twist operation in the open-end spinning unit have been proposed, one of them being disclosed in U.S. Pat. No. 3,640,061. In the U.S. Pat. No. 3,640,061, a thread drawoff tube is provided with a rough or notched inner annular surface and a smooth outer radial surface extending into the yarn path toward the binding-in point of the fiber collecting surface of the spinning rotor. Therefore, it is said that possible oscillations of the thread in the false twisting zone can be damped by contacting the thread with the smooth surface of the thread drawoff tube. It is my understanding that the abovementioned U.S. Pat. No. 3,640,061 is one of the solutions to eliminate spinning difficulties such as improper twist transmission in the false twisting zone of the conventional drawoff tube. However, in the thread drawoff tube of the above prior art, there is still a problem in that the thread surface may be damaged by excessive frictional contact of the thread with the roughened or notched mouth surface of the tube.

It is the principal object of the present invention to provide an improved thread drawoff tube so as to create a useful false twist operation without oscillations of the thread in the false twisting zone and which also eliminates the above-mentioned problem of the prior art.

By conducting repeated mill tests, I have found a solution to the problem, which is different from the abovementioned prior art. In my solution to the problem, I first considered how to prevent the possible damage to the thread appearance which is created by excessive friction in the contact of the thread with the roughened or notched mouth surface of the drawoff tube. This is because in the prior art, the thread is forced to contact the roughened or notched mouth surface so as to effectively create the above-mentioned false twisting. However, it the above-mentioned roughened or notched surface is formed in such a condition that it is only slightly abrasive, the above-mentioned false twisting becomes insufficient and the thread in the false twisting zone frequently tends to break. To eliminate this problem in the thread drawoff tube according to the present invention, instead of the smooth surface of the thread drawoff tube disclosed in the U.S. Pat. No. 3,640,061, at least one roughened or notched surface having a weak friction resistance is provided. Consequently, even though the power for creating the false twisting by the roughened or notched mouth surface is weak in comparison with the prior art, the above-mentioned additional roughened or notched surface or surfaces assist the false twisting and, as a result, sufficient false twisting is imparted to the bundle of fibers in the false twisting zone without damaging the thread appearance.

Other objects and characteristic features of the present invention will appear more clearly from the detailed illustration of the preferred embodiments in connection with the accompanying drawings and claims.

BRIEF EXPLANATION OF THE DRAWINGS

FIG. 1 is a schematic sectional view of a conventional assembly of a spinning rotor with a thread drawoff tube, taken along the longitudinal axis thereof;

FIG. 2 is an enlarged sectional side view of the thread drawoff tube shown in FIG. 1;

DETAILED ILLUSTRATION OF THE INVENTION

Figure 3:
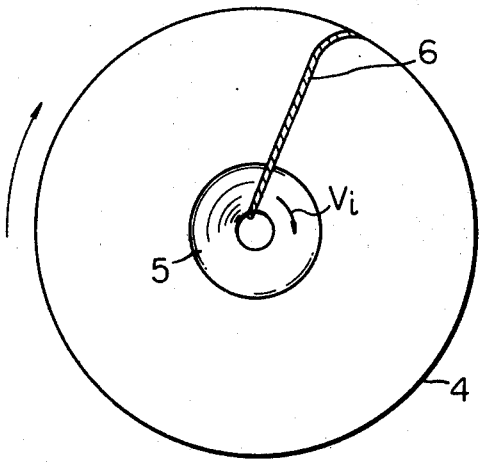
FIG. 3 is an explanatory plan view of the assembly shown in FIG. 1, which indicates the relative disposition of the fiber collecting surface of the spinning rotor and the thread drawoff tube.

For the sake of a clearer understanding of the present invention, the basic idea of the present invention will be illustrated first.

Referring to FIG. 1, in the assembly of a conventional spinning rotor 1 with a thread drawoff tube 5 of an open-end spinning unit, the spinning rotor 1 is rotated at very high speed so that a negative air pressure is created inside the spinning rotor 1 by discharging air through discharge conduits 2 formed in the rotor 1. Consequently, an air stream toward the inside chamber of the spinning rotor 1, through a fiber supply aperture 3, is created. Liberated fibers are carried into the inside chamber of the spinning rotor 1 by the above-mentioned air stream. These liberated fibers are collected upon a ring shaped fiber collecting surface 4 formed on the peripheral inside surface of the spinning rotor 1 where the diameter is maximum. A bundle of fibers, which becomes an upstream end portion of a spun thread 6, is drawn off from a thread binding-up point on the rotating collecting surface 4 of the spinning rotor 1. The thread 6 is delivered from a yarn passage formed in the drawoff tube 5 and to a takeup mechanism (not shown) of the spinning unit so as to make a yarn package. As already explained, in the above-mentioned drawing off motion of the bundle of fibers, when the fibers are drawn off from the fiber collecting surface 4 of the spinning rotor 1 and carried to the mouth of the drawoff tube 5, the bundle of fibers is provided with a false twist. This false twist is positively created by the rolling of the bundle of fibers about the longitudinal axis thereof due to the frictional contact of the thread 6 with the roughened or notched surface formed at the mouth portion of the thread drawoff tube. The major twists are imparted to the thread 6 by high speed rotation of the thread binding-in point as the rotor turns. In other words, before providing the major twists, the bundle of fibers taken from the binding-in point of the fiber collecting surface 4 are initially provided with the false twists so that the bundle of fibers forms a thread and, consequently the possible breakage of thread in the spinning rotor 1 can be effectively prevented. However, if the friction between the bundle of fibers and the contacting surface of the drawoff tube is too strong, the outside surface of the thread 6 becomes fluffy, so that the quality of the thread 6 is degraded.

Figure 4:
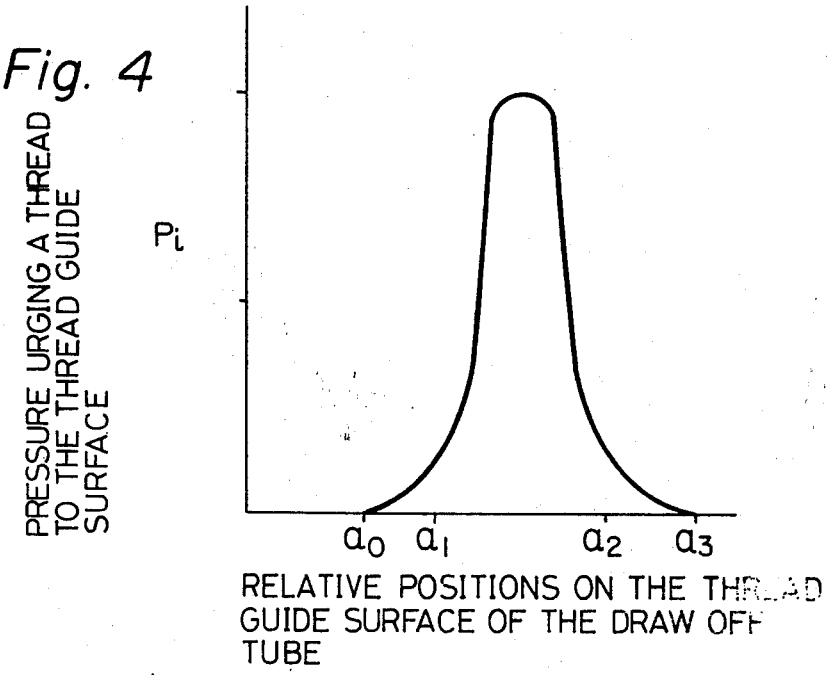
FIG. 4 is an explanatory diagram showing the relation between the relative positions on the thread guide surface of the drawoff tube and the contact pressure Pi of the thread with the guide surface at those positions of the thread drawoff tube shown in FIG. 2.

Referring to FIGS. 2 and 3, the thread 6 contacts a trumpet shaped yarn guide surface of the thread drawoff tube 5 under a contacting pressure Pi, which is defined by yarn tensions $T_1$ and $T_2$ and the shape of the yarn guide surface, where $T_1$ represents the yarn tension in the false twisting zone, while $T_2$ represents the yarn tension in the delivery side of the drawn off tube 5. The above-mentioned contact pressure Pi varies along the curved yarn path of the tube 5, as shown in FIG. 2, wherein the magnitude of the pressure Pi is represented by the length of each arrow which also indicates the direction in which the pressure is imparted. In the mouth portion of the thread drawoff tube 5 shown in FIG. 2, the outside portion of the yarn passage is represented by B, the delivery side portion of the yarn passage is represented by C and the intermediate portion thereof is represented by A. The boundaries of these B, A and C portions are represented by $a_0$, $a_1$, $a_2$ and $a_3$. The A portion has the maximum curvature, while the B and C portions are more flattened. In this condition, the curve of the variation of the contacting pressure Pi along the yarn passage formed in the above-mentioned B, A and C portions is shown in FIG. 4, wherein the maximum contacting pressure Pm is created at a middle of the A portion, and a comparatively large but smaller contacting pressure is created at the other parts of the A portion. Therefore, the roughened or notched surface is formed at the above-mentioned A portion so as to effectively create the rolling motion of the bundle of fibers in the yarn passage between the binding-in point of the fiber collecting surface of the spinning rotor 1 and the mouth of the drawoff tube 5. However, as already explained, if the frictional contact of the thread 6 with the above-mentioned roughened or notched surface is excessive, the thread surface may be damaged. Consequently, if the above-mentioned roughened or notched surface formed at the A portion is formed in such a condition that it is only mildly abrasive in comparison with the above-mentioned prior art, the effect of the frictional contact of the thread 6 with the roughened or notched surface of the A portion is insufficient for creating the false twists. To compensate for the abovememtioned insufficient creation of the false twists, it is preferable to form an additional roughened or notched surface at the B portion. That is, the additional roughened or notched surface assists in creating the false twisting of the bundle of fibers in the false twisting zone. The relative circulation speed Vi of each point in the thread guide passage on the tube 5 is larger if the point is located at a position closer to the fiber collecting surface 4 of the spinning rotor 1 (FIG. 3). Consequently, if a roughened or notched surface similar to that of the A portion is formed at the B portion, which is closer to the fiber collecting surface 4, the action of the portion B is rather excessive so that the outer surface of the bundle of fibers in the false twisting zone may be scratched. To prevent this problem, it is preferable to form a more mild roughened surface or notched surface at the B portion than that formed at the A portion of the drawoff tube 5.

According to the above-mentioned basic idea of the present invention, the thread drawoff tube 5 of the present invention is provided with a roughened or notched surface formed at the A portion and an additional but milder roughened or notched surface formed at the B portion. However, it is also effective to provide more than two ring shaped portions having roughened surfaces which gradually become less abrasive toward the direction of the fiber collecting surface 4 of the spinning rotor 1.

Several embodiments of the thread drawoff tube 5 of the present invention are hereinafter illustrated with reference to the attached drawings.

Figure 5:
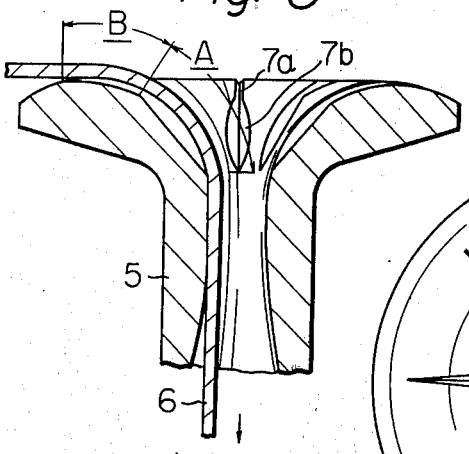
FIG. 5 is a schematic sectional view of an embodiment of the thread drawoff tube in accordance with the present invention, taken along the longitudinal axis thereof.
Figure 6:
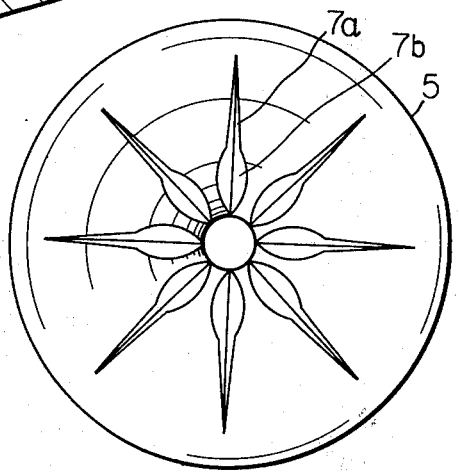
FIG. 6 is a plan view of the thread drawoff tube shown in FIG. 5.

Referring to FIGS. 5 and 6, the thread drawoff tube 5 is provided with a plurality of notches 7 radially formed at the mouth portion of the thread drawoff tube. Each notch 7 is composed of a shallow and mild portion 7*a* formed at the above-mentioned B portion and, also, a deep portion 7*b* formed at the above-mentioned A portion, where the higher contacting pressure is created and where the relatively slower rotational displacement speed about the axis of the tube is created in comparison to the B portion. The relative condition of the frictional resistance of these notches can be changed by changing the depth and width of the notches.

Figure 7:
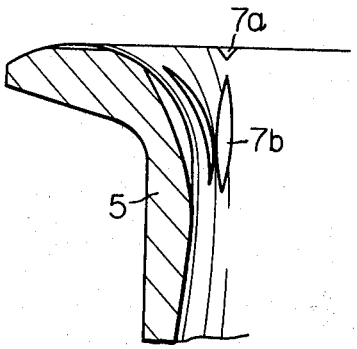
FIG. 7 is a schematic sectional view of a part of another embodiment of the thread drawoff tube in accordance with the present invention taken along the longitudinal axis thereof.
Figure 8:
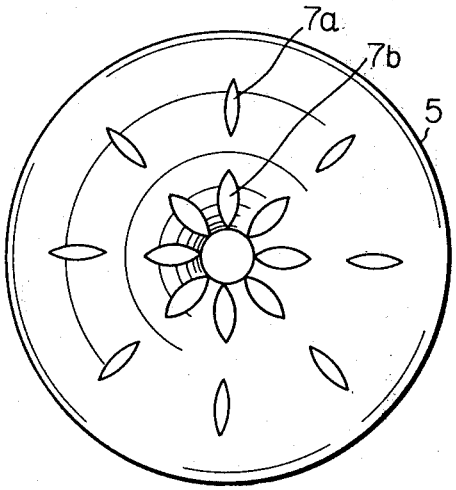
FIG. 8 is a plan view of the thread drawoff tube shown in FIG. 7.

In the embodiment shown in FIGS. 7 and 8, the above-mentioned notches 7*a*,7*b* are arranged in separated condition. Instead of forming the notches 7 in the yarn guide surfaces at the A and B portions of the tube 5, ribs may be radially formed on the yarn passage so as to construct a yarn guide surface having frictional resistance. In this modification, the desirable effect similar to the above-mentioned embodiment can be attained.

Figure 9:
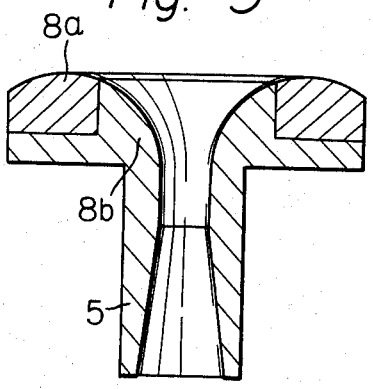
FIG. 9 is a schematic sectional view of still another embodiment of the thread drawoff tube in accordance with the present invention, taken along the longitudinal axis thereof.

In the embodiment shown in FIG. 9, the yarn guide surface composed of the above-mentioned A and B portions is constructed of two different materials having different properties of frictional resistance. That is, the B portion is made of a material 8*a* having mild frictional resistance, while the A portion is made of a material 8*b* having greater frictional resistance in comparison with the B portion, and the A portion is combined with the B portion as one body. In this embodiment, if the B portion is detachably mounted on the tube 5 while the A portion is an integral part of tube 5, and several B portion elements having different frictional resistance are prepared, the resulting capability to form different combinations of these A and B portions on the same tube 5 is very useful in practical mill operation.

Figure 10:
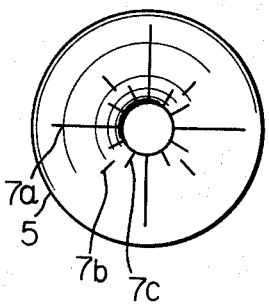
FIGS. 10 and 11 are schematic plan views of the thread drawoff tube shown in FIG. 9, showing two different arrangements of notches for creating friction resistance according to the present invention.

In the embodiment shown in FIG. 10, the number of notches or projected ribs, which are referred to as friction creation elements, and are disposed on the outer side of ring shaped thread guide portions, is less than that at the center of the ring shaped thread portions of the tube 5. Consequently, the friction between a bundle of fibers and the friction creation elements is gradually reduced toward the outer portions of the ring shaped thread guide portions. In this embodiment, these friction creation elements are represented by *7a*, *7b* and *7c*.

Figure 11:
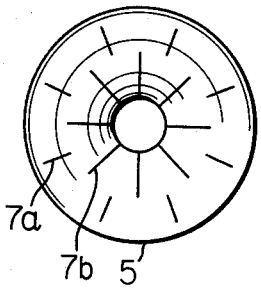

In the embodiment shown in FIG. 11, a plurality of effective friction creation elements *7b* are arranged at the above-mentioned A portion of the tube and the less abrasive friction creation elements *7a* are arranged at the B portion of the tube. These arrangements are such that the radial disposition of the friction creation elements *9b* is displaced from that of the friction elements *9a*.

I have confirmed by mill tests that spinning difficulties such as yarn breakage in the false twisting zone of the spinning rotor assembly can be perfectly solved by application of the thread drawoff tube according to the present invention. In addition, thread having excellent thread appearance without any roughened outersurface or neps can be produced.

A further practical advantage is that, with the present invention, an open-end spinning machine can be used for various textile materials simply by changing to thread drawoff tubes with different frictional resistances.

An additional substantial advantage of the present invention is that the conventional assembly of the spinning rotor with the thread drawoff tube can be easily and simply modified so that the thread drawoff tube can be changed.

What is claimed is:

1. In an assembly of a spinning rotor and a thread drawoff tube of an open-end spinning unit, said spinning rotor being capable of rotating about an axis thereof and provided with a ring shaped fiber collecting surface formed at an inside ring shaped wall having maximum rotational diameter, said thread drawoff tube disposed coaxially in stationary condition at a position along an extended line of said axis of said spinning rotor and provided with a hollow yarn guide for delivering a continuous thread from said assembly and a flange portion extending from an inside terminal of said hollow tube toward said fiber collecting surface of said spinning rotor, the improvement comprising an improved thread drawoff tube provided with a thread passage, said thread passage having frictional resistance along a portion of said thread passage contacted by said thread having inner and outer ends for creating a rolling motion of said thread by frictional contact therewith when said thread is being delivered from said assembly, said thread passage provided with a continuous trumpet shaped friction surface in said portion of said thread passage, said portion of said thread passage having surface variations providing an effective coefficient of friction of said frictional resistance that gradually decreases toward the edge of said flange portion, said surface variations extending from said inner and outer ends of said portion of said thread passage and continuously contacting said thread.

2. An improved thread drawoff tube for use in an open end spinning unit, said thread drawoff tube having a thread passage for receiving thread therein, means in said thread drawoff tube for imparting false twists to said thread comprising a trumpet shaped thread contacting portion, the surface of said trumpet shaped portion contacting said thread having inner and outer ends and having surface variations extending from said inner and outer ends and providing an effective coefficient of friction which decreases from an inner portion thereof to the outer end portion thereof, said thread continuously contacting said entire trumpet shaped thread contacting portion.

3. An improved thread drawoff tube according to claim 2, wherein said surface variations comprise a curved ring surface having a frictional resistance and at least one substantially flat ring shaped surface expanded from said curved ring surface, said flat ring shaped surface having less frictional resistance than said curved ring surface.

4. An improved thread drawoff tube according to claim 3, wherein said substantially flat ring surface is composed of at least two spaced ring shaped friction surfaces located on both sides of said curved ring surface, each said ring shaped friction surface having less frictional resistance than said curved ring shaped friction surface.

5. An improved thread drawoff tube according to claim 3, wherein said curved ring surface is provided with a plurality of radially arranged notches, while said substantially flat ring surface is also provided with a plurality of radially arranged notches, each of said notches formed on said curved ring surface having stronger frictional resistance than that of said substantially flat ring surface.

6. An improved thread drawoff tube according to claim 5, wherein said notches of said substantially flat ring surface are formed at each outwardly extended line of said notches formed on said curved ring surface, each pair of said notches formed on said curved ring surface and flat ring surface being connected to each other.

7. An improved thread drawoff tube according to claim 5, wherein the number of said notches formed on said substantially flat ring surface is less than the number of notches formed on said curved ring surface.

8. An improved thread drawoff tube according to claim 3, wherein said flange portion is detachably mounted on a body containing said hollow tube, said flange portion comprising said substantially flat ring friction surface, said hollow tube having a terminal thereon which terminal comprises said curved ring friction surface.

9. An improved thread drawoff tube according to claim 2 wherein said surface variations in said trumpet shaped friction surface comprise a plurality of radially arranged means for frictionally contacting said thread, each of said friction creation means having frictional resistance which gradually decreases toward the edge of said flange portion.

10. An improved thread drawoff tube according to claim 9, wherein said friction creation means are projecting ribs formed radially on said trumpet shaped friction surface.

* * * * *